United States Patent [19]

Bowers

[11] Patent Number: 4,572,975

[45] Date of Patent: Feb. 25, 1986

[54] ANALOG MULTIPLIER WITH IMPROVED LINEARITY

[75] Inventor: Derek F. Bowers, Sunnyvale, Calif.

[73] Assignee: Precision Monolithics, Inc., Santa Clara, Calif.

[21] Appl. No.: 595,905

[22] Filed: Apr. 2, 1984

[51] Int. Cl.[4] ..... G06G 7/12

[52] U.S. Cl. ..... 307/498; 307/270; 328/160

[58] Field of Search ..... 307/498, 270, 297; 328/160, 144

[56] References Cited

U.S. PATENT DOCUMENTS

| | | | |
|---|---|---|---|
| 4,157,512 | 6/1979 | Schmoock | 328/161 |
| 4,308,471 | 12/1981 | Misawa | 307/498 |
| 4,482,977 | 11/1984 | Ross | 328/160 |

OTHER PUBLICATIONS

B. Gilbert, "A Precise Four-Quadrant Multiplier with Subnansecond Reponse", IEEE J. Solid-State Circuits, vol. SC-3, pp. 365-373, Dec. 1968.

B. Gilbert, "A High-Performance Monolithic Multiplier Using Active Feedback", IEEE J. Solid-State Circuits, vol. SC-9, pp. 364-373, Dec. 1974.

B. Gilbert, "A Four-Quadrant Analog Divider/Multiplier with 0.01% Distortion", IEEE International Solid-State Circuits Conference, Feb. 25, 1983.

*Primary Examiner*—Stanley D. Miller
*Assistant Examiner*—B. P. Davis
*Attorney, Agent, or Firm*—Koppel & Harris

[57] ABSTRACT

An analog multiplier circuit for multiplying X and Y input voltage signals and using two differential amplifiers to produce a multiplied output, in which separate pairs of transistors provide base drive currents to the amplifier transistors, one pair being associated with each amplifier. Trimming voltages are applied between the bases of each transistor pair to independently adjust the base voltage offsets. Nonlinearities between the multiplier output and the X input are reduced by appropriate trimming of the transistor base voltage differentials. Each of the differential amplifier transistors has a common base connection with a matching transistor that carries a current which is complementary to the amplifier transistor current with respect to the Y input signal, thereby reducing output nonlinearities with respect to the Y input signal by making the total base drive currents of both transistors substantially independent of the Y voltage signal. Separate current sources also supply the standing base currents for the transistors of one of the amplifiers, thereby correcting for static imbalances in the base drive circuitry.

16 Claims, 6 Drawing Figures

ANALOG MULTIPLIER WITH IMPROVED LINEARITY

BACKGROUND OF THE INVENTION

1. Field of the Invention

This invention relates to electronic circuitry, and more particularly to circuits for multiplying two electrical signals.

2. Description of the Prior Art

Four-quadrant multiplier circuits ideally multiply together two voltage signals X and Y to produce an output which is proportional to the product of the two signal magnitudes, and has the correct algebraic sign. A popular circuit which employs an inverted form of a four-quadrant multiplier circuit is disclosed in the following articles by Barrie Gilbert: "A Precise Four-Quadrant Multiplier with Subnanosecond Response", IEEE Journal of Solid-State Circuits, vol. SC-3, pp. 365–373, December 1968; "A High Performance Monolithic Multiplier Using Active Feedback", IEEE Journal of Solid-State Circuits, vol. SC-9, pp. 364–373, December 1974.

An equivalent schematic diagram of a circuit disclosed in the above references is shown in FIG. 1. Four current sources I1, I2, I3 and I4 are derived from the multiplied voltage signals X and Y in the form $xI_B$, $(1-x)I_B$, $yI_E$ and $(1-y)I_E$, respectively, where x and y are respectively dimensionless indices of X and Y, in the range zero to unity, and $I_B$ and $I_E$ are fixed currents. A pair of npn transistors Q1 and Q2 conduct current through their collector-emitter circuits from a positive voltage bus V+ to I1 and I2, respectively. (While Q1 and Q2 are generally shown in the printed references as being diode connected, with their bases and collectors tied together, in practice they are normally formed with their bases connected to a separate bias point. The transistors operate in an equivalent fashion with either type of connection.)

The prior art multiplier circuit of FIG. 1 employs a pair of differential amplifiers to produce a multiplied output. The first amplifier comprises npn transistors Q3 and Q4, the emitters of which are connected together to supply current to I3, the bases of which are connected for biasing by the emitters of Q2 and Q1, respectively, and the collectors of which are connected to output lines 2 and 4, recpectively. The second differential amplifier is similar to the first, comprising npn transistors Q5 and Q6. The emitters of Q5 and Q6 are connected together to supply current to I4, their bases are connected for biasing by the emitters of Q1 and Q2, respectively, and their collectors are connected to output lines 2 and 4, respectively. As a result of this arrangement, output line 2 carries a current in the form $(xy/2)I_0$ while output line 4 carries a current in the form of $(1-xy/2)I_0$, $I_0$ being a fixed output current.

A principal limitation of the FIG. 1 circuit is that, with a constant Y input voltage, the output is nonlinear with respect to changes in the X input voltage. This problem has been traced to mismatches which are present in conventional transistors, and occurs when the transistor saturation currents are not equal. In the 1974 Gilbert reference identified above it was shown that this X nonlinearity results from voltage offsets between the transistor pairs Q1,Q2 and Q3,Q4, and the transistor pairs Q1,Q2 and Q5,Q6. As little as 50 microvolts of offset voltage can produce a 0.1% nonlinearity. Thus, for a typical nonlinearity specifiction of 0.1%, very poor yields will be produced for integrated circuits using conventional processing techniques.

A circuit which addresses the offset voltage problem is disclosed in another article by Gilbert, "A Four-Quadrant Analog Divider/Multiplier with 0.01% Distortion", IEEE International Solid-State Circuits Conference, Feb. 25, 1983. In this circuit, illustrated in FIG. 2, small controlled voltage drops are introduced between the bases of Q1 and Q2 and the bases of the other transistors to compensate for the undesired offset voltages. The compensation voltages are developed across resistors R1, R2, R3 and R4 by means of trim currents I5, I6, I7 and I8, the trim currents being controlled by laser adjustment or other conventional means. While this circuit substantially resolves the offset voltage problem, the trim currents interfere with the normal operating currents in Q1 and Q2, causing large errors. These errors can be corrected by the addition of further compensation circuitry, but that adds to the complexity of the overall circuit.

SUMMARY OF THE INVENTION

In view of the above problems associated with the prior art, the object of the present invention is the provision of a novel and improved four-quadrant multiplier circuit which is substantially linear with respect to both input signals being multiplied, which is accurate, and which is not unduly complex.

In the accomplishment of these and other objects, Q1 and Q2 are replaced by two sets of transistor pairs, with one pair controlling the bias on the transistors of the first differential amplifier and the second pair controlling the bias on the transistors of the second differential amplifier. The transistors of the first pair are connected in series with the transistors of the second pair and means are provided to trim any voltage differential between the bases of the transistors of each pair, whereby nonlinearities in the circuit operation with respect to the X input signal may be reduced by appropriate trimming of the base voltage differentials. The voltage trimming means are preferably adapted to apply trimming voltages which are substantially directly proportional to absolute temperature over a predetermined temperature range.

Nonlinearities with respect to the Y input signal are reduced by making current imbalances between the first and second sets of transistors independent of the Y voltage signal. This is accomplished by adding additional transistors which are matched with and have common base connections with the differential amplifier transistors. For the amplifier supplied by the $yI_E$ current source the additional transistors are supplied with current from the $(1-y)I_E$ current source, while for the amplifier supplied by the $(1-y)I_E$ current source the additional transistors are supplied by the $yI_E$ current source. The net result is to make any imbalance in operating currents between the two pairs of transistors independent of the Y input. Additional current sources provide base current to the transistors of one of the differential amplifiers to correct for static current imbalances.

The overall circuit is a four-quadrant multiplier with little or no nonlinearity with respect to the Y input, and a nonlinearity with respect to the X input which is trimmable to a very small or zero level. Further objects and features of the invention will be apparent to those skilled in the art from the following detailed description of a preferred embodiment, taken together with the accompanying drawings, in which:

DETAILED DESCRIPTION OF A PREFERRED EMBODIMENT

Figure 1:
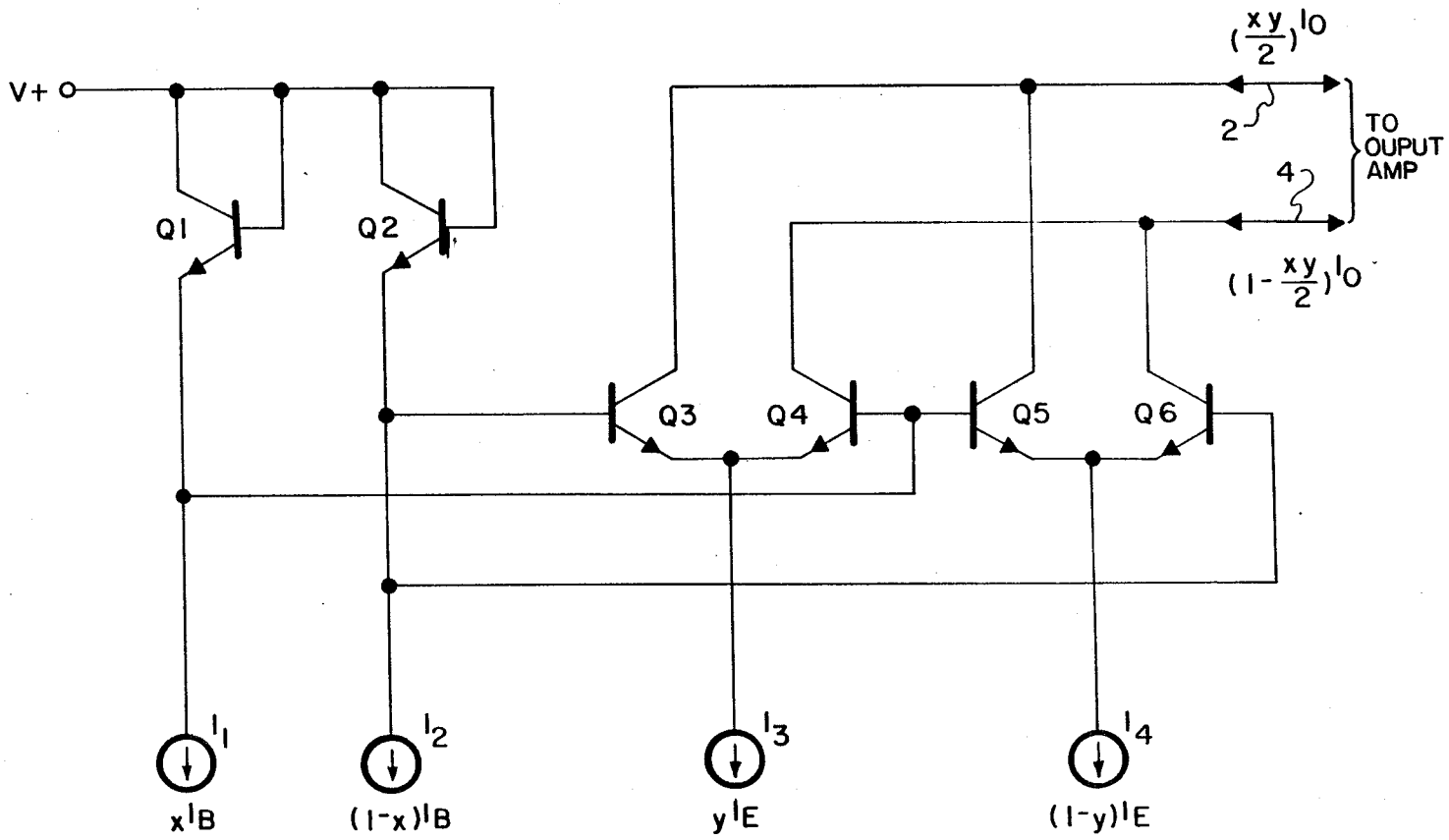
Fig. 1. (PRIOR ART)
FIGS. 1 and 2 are schematic diagrams of prior art multiplier circuits.
Figure 2:
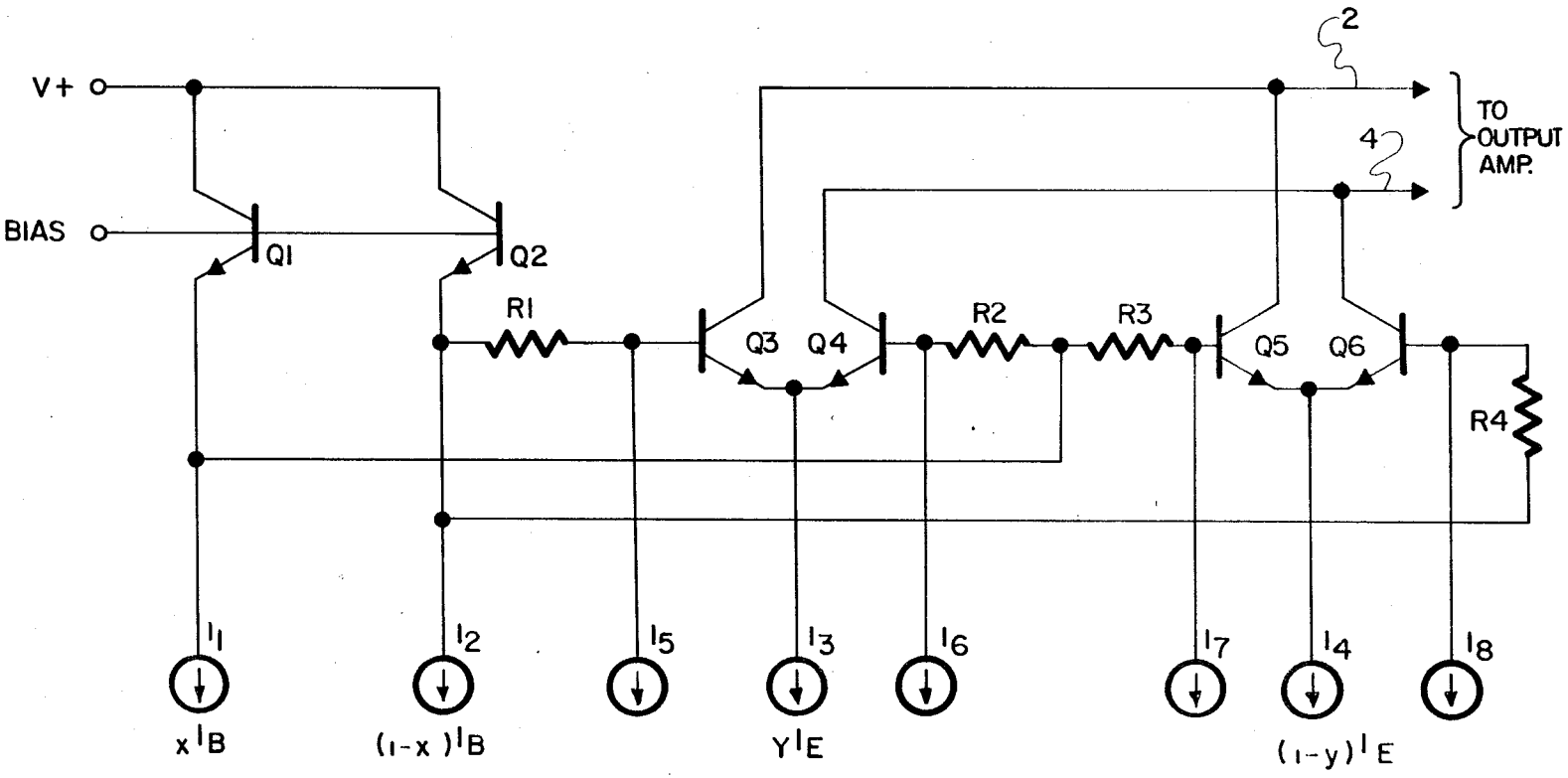
FIG. 2. (PRIOR ART)
Figure 3:
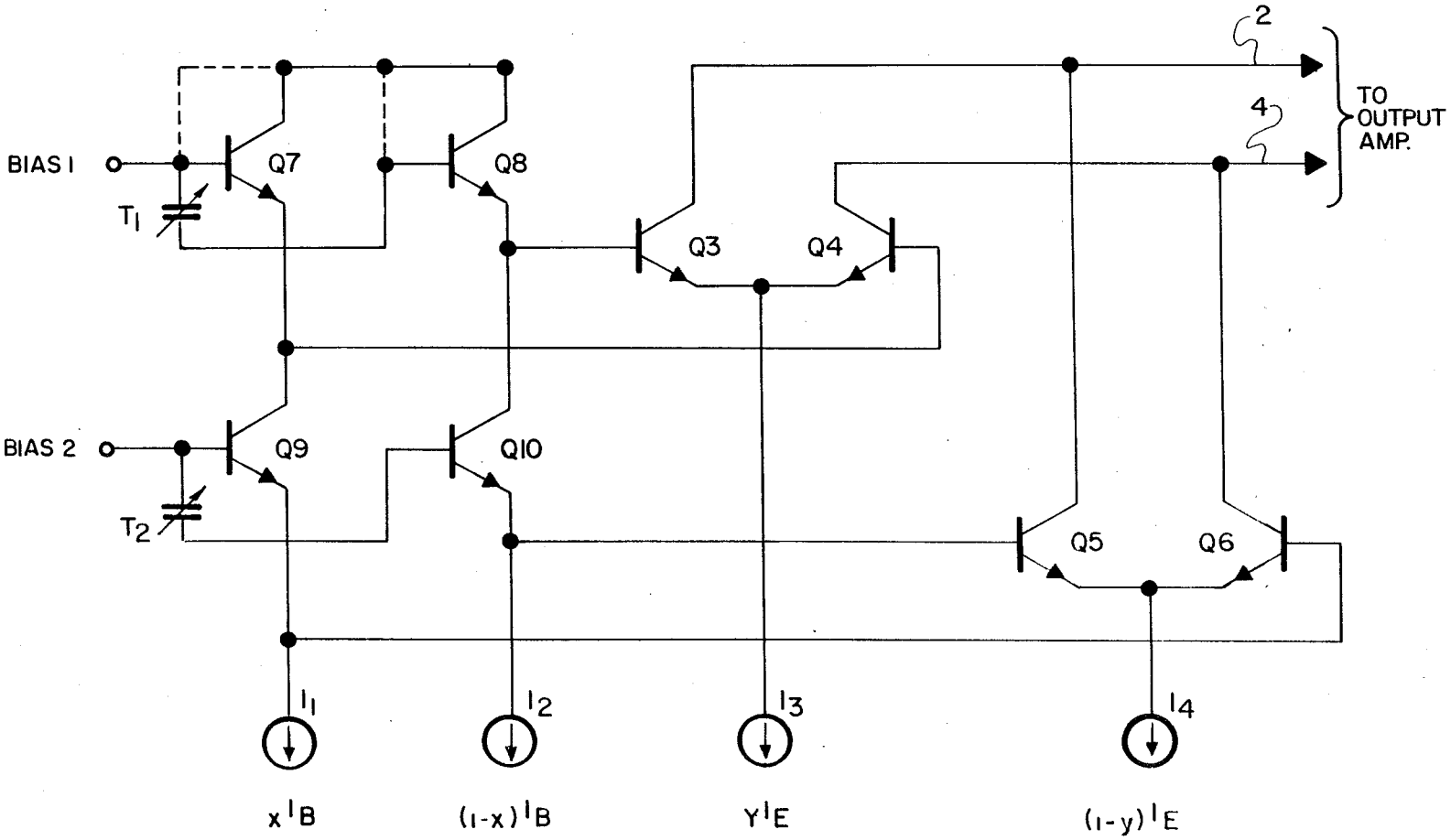
FIG. 3 is a schematic diagram of a multiplier circuit constructed in accordance with the present invention which substantially eliminates X nonlinearity, but suffers from Y nonlinearity.

The circuit shown in FIG. 3 substantially corrects the X signal nonlinearity problem associated with the prior art FIG. 1 circuit, without interfering with the normal transistor operating currents and without unduly complicating the circuitry as in the prior art circuit of FIG. 2. The transistors of FIG. 3 are of the npn type; pnp transistors could also be used with an appropriate reversal of the circuit polarity, but npn devices are preferred because of practical difficulties in successfully implementing pnp devices.

In place of a single transistor pair Q1,Q2, the FIG. 3 circuit uses two sets of paired transistors Q7,Q8 and Q9,Q10, with each pair biasing the transistors of an associated differential amplifier. The first transistor pair comprises Q7 and Q8, the emitters of which are connected to provide base drive currents to differential amplifier transistors Q4 and Q3, respectively. The second pair of transistors comprises Q9 and Q10, the emitters of which are connected to provide base drive currents to differential amplifier transistors Q6 and Q5, respectively. The collector-emitter circuits of Q7 and Q9 are connected in series and supplied with current from I1, with the collector of Q7 connected to V+ and the emitter of Q9 connected to I1. Similarly, the collector-emitter circuits of Q8 and Q10 are connected in series and supplied with current by I2, with the collector of Q8 connected to V+ and the emitter of Q10 connected to I2. Alternately, the transistor pairs Q7,Q8 and Q9,Q10 could be separated from each other, with each pair connected directly between V+, I1 and I2. Q7 and Q8 could also be implemented as diodes; diode connections between the transistor bases and collectors are indicated in dashed lines on FIG. 3.

Figure 4:
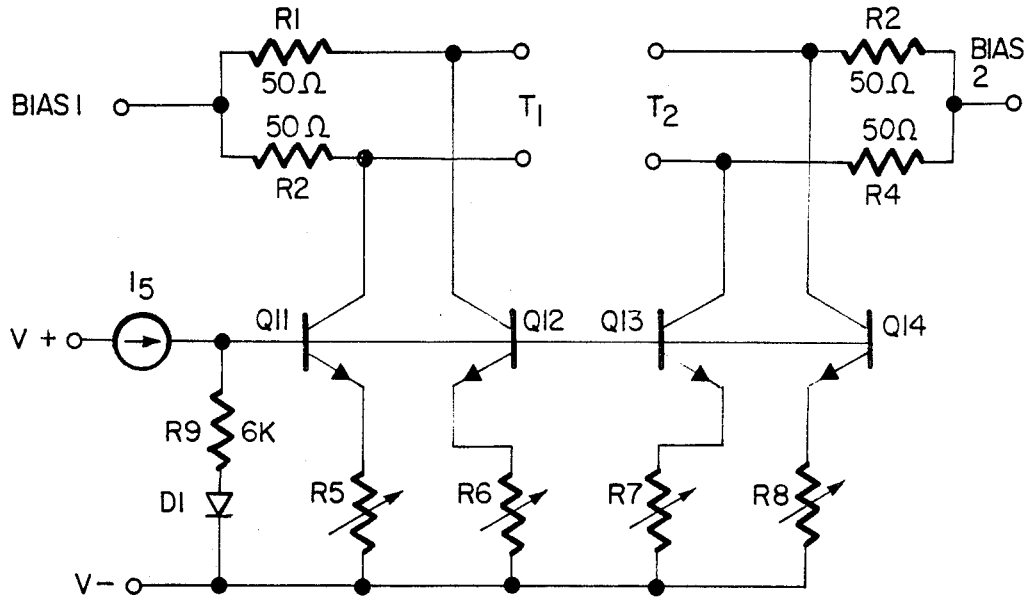
FIG. 4 is a schematic diagram of a circuit for generating the trimming voltages used in the FIG. 3 circuit.

A voltage trimming circuit schematically represented as variable voltage generator T1 is connected between the bases of Q7 and Q8, while a similar voltage trimming circuit T2 is connected between the bases of Q9 and Q10. These voltage trimming circuits, details of which are shown in FIG. 4, permit the voltage offsets of Q7,Q8 relative to Q3,Q4, and the voltage offsets of Q9,Q10 relative to Q5,Q6, to be adjusted independently of each other. This reduction in voltage offsets is accompanied by a corresponding reduction in the nonlinearity of the circuit with respect to the X input signal.

The bases of Q7 and Q9 are connected to receive respective voltage bias signals; the bias level on Q7 must exceed the bias on Q9 by at least the transistor base-emitter voltage (about 0.7 volts) to prevent Q9 and Q10 from saturating. Without the trimming circuits, and ignoring the second order effects of transistor base currents by assuming infinite transistor current gain, the multiplier circuit of FIG. 3 functions substantially identically to the FIG. 1 circuit. However, the addition of the trimming circuits substantially reduces the X nonlinearity.

Referring now to FIG. 4, details of the voltage trimming circuits are shown. The first bias signal is applied through resistors R1 and R2 to the opposite terminals of trimming circuit T1, while the second bias terminal is connected through resistors R3 and R4 to the opposite terminals of trimming circuit T2. The trimming circuit terminals are connected respectively to the collectors of transistors Q11, Q12, Q13 and Q14, which is turn are connected respectively through variable resistors R5, R6, R7 and R8 to V−. Q11–Q14 have a common base connection and receive base current from a current source I5, the output of which varies in direct proportion to absolute temperature. A series circuit comprising resistor R9 and diode D1 is connected between the bases of Q11–Q14 and V− to avoid overbiasing the transistors.

Variable resistors R5–R8 can be trimmed by conventional techniques such as laser trimming or "zener zap" trimming until the desired voltage differential across T1 and T2 is achieved. Varying the base drives on transistors Q11–Q14 by means of a temperature dependent current source ensures that the currents transmitted through those transistors, and hence the T1 and T2 trimming voltages, will likewise be proportional to absolute temperature. The multiplier circuit is thus provided with automatic temperature compensation so that the voltage offset between Q7,Q8 and Q3,Q4 and between Q9,Q10 and Q5,Q6 remains very small over a predetermined temperature range.

While the circuit of FIG. 3 substantially reduces or eliminates X nonlinearity, it introduces Y nonlinearity. This may be traced to two causes. First, because practical transistors have finite current gains, the differential amplifier transistors will draw greater than zero base currents, and Q7 and Q8 will run at slightly higher currents than Q9 and Q10. This in turn produces a slightly lower effective gain for the top half of the multiplier circuit shown in FIG. 3 relative to the bottom half. Secondly, this difference in currents is not constant, but is itself a function of the Y input signal.

Figure 5:
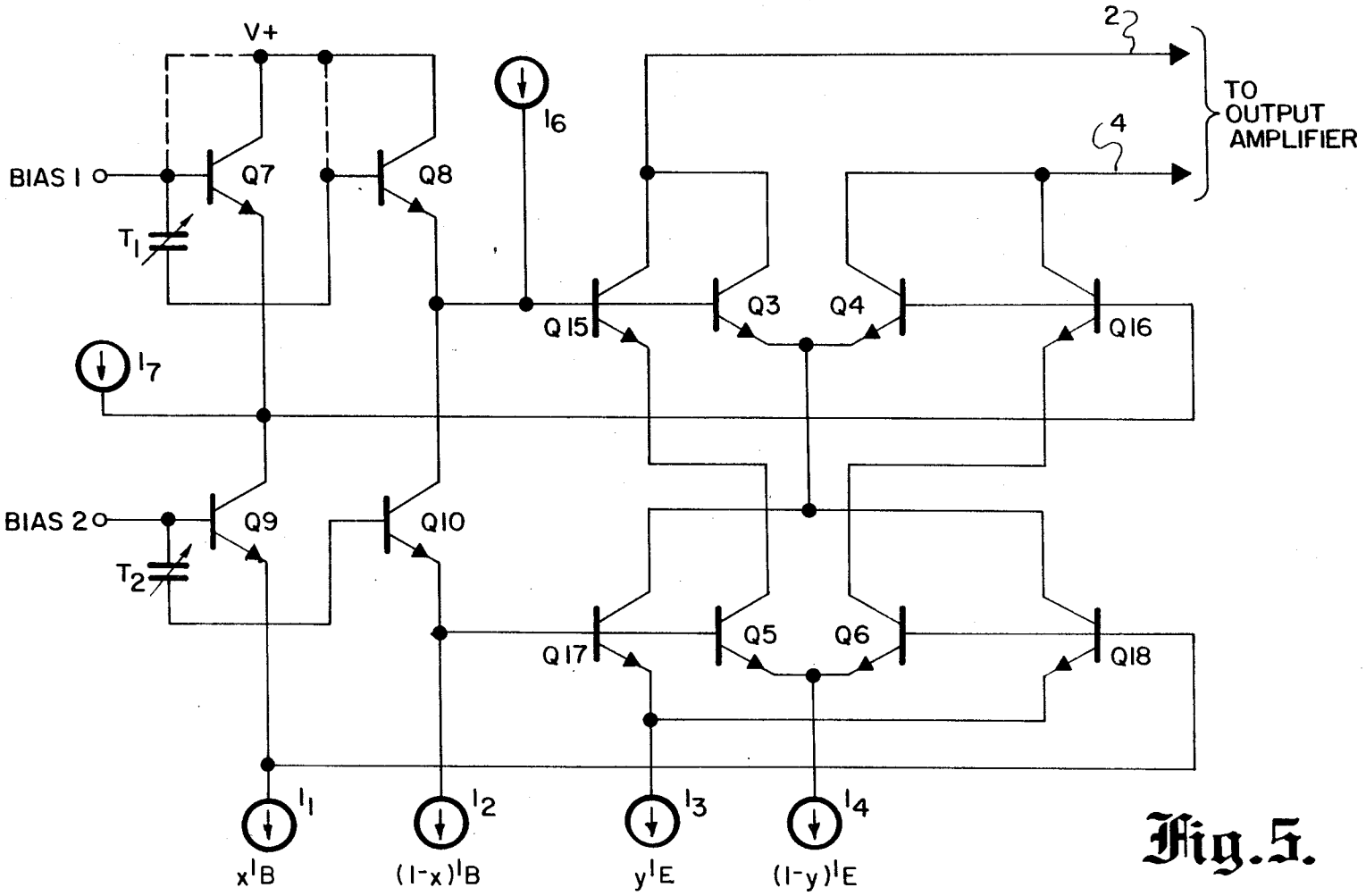
FIG. 5 is a schematic diagram of an improvement to the FIG. 4 circuit which substantially eliminates Y nonlinearity.

FIG. 5 shows a circuit which resolves the Y nonlinearity problem. In this circuit, which builds upon the basic circuitry of FIG. 3, additional compensation transistors are driven by the emitters of Q7–Q10 in such a manner that the base drive currents provided by the latter transistors are substantially independent of the Y voltage signal. Additional npn transistors Q15, Q16, Q17 and Q18 are matched with and have common base connections with Q3, Q4, Q5 and Q6, respectively. The collectors of Q15 and Q16 are connected to output lines 2 and 4, respectively, while their emitters are connected to the collectors of Q5 and Q6, respectively, and thereby to I4. The collectors of Q17 and Q18 are connected to the common emitter connection of Q3 and Q4, while their emitters are connected directly to I3. In this manner, the $yI_E$ current supplied by I3 is steered through Q3, Q4, Q17 and Q18, while the $(1-y)I_E$ current of I4 is steered through Q15, Q16, Q5 and Q6. Thus, each of the transistors Q7–Q10 will provide a base drive current to one transistor whose collector-emitter current is proportional to $yI_E$, and also to a second transistor whose collector-emitter current is proportional to $(1-y)I_E$. The cumulative effect of the dual complementary base drive currents provided by each transistor Q7–Q10 is to make the imbalance in operating currents between Q7,Q8 and Q9,Q10 substantially independent of the Y input, thereby substantially eliminating Y nonlinearities at operating current levels.

Figure 6:
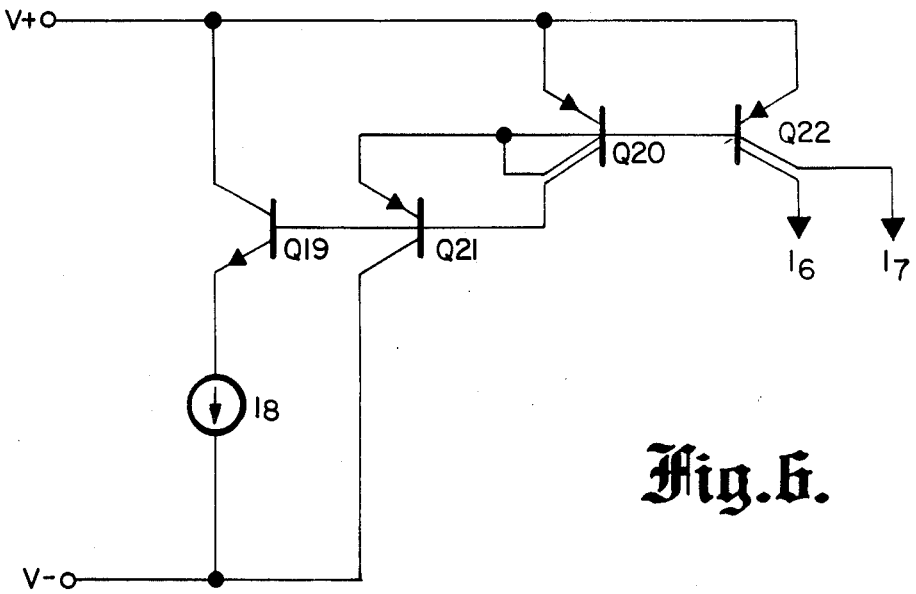
FIG. 6 is a schematic diagram of circuitry used to generate compensating standing currents employed in the FIG. 5 circuit.

The multiplier circuit as described thus far still has a static current imbalance between Q7,Q8 and Q9,Q10. The magnitude of this current imbalance can be calculated as $2I_X/B$, where $I_X$ is the standing current in Q7 or Q8 with no X input, and B is the transistor current gain. To compensate for this imbalance, current sources I6 and I7 are provided to supply balancing currents to the bases of Q3 and Q4, respectively. Each of these current sources generates a balancing current of equal magnitude to the imbalance described above by using the base current of a transistor which is identical to the differential amplifier transistors when run at a constant emitter current. A circuit for generating these currents is shown in FIG. 6. Transistor Q19, which is identical to the differential amplifier transistors, transmits a constant current supplied by a constant current source I8 connected to its emitter. The resulting base current of Q19 is equal to its collector current divided by B. This current is provided by one collector of a multi-collector transistor Q20, which also draws base current from a pnp transistor Q21. The other collector of Q20 is connected to its base and then to the emitter of Q21. The base of Q20 is also connected to the base of a second dual collector pnp transistor Q22, the dual collectors of which provide I6 and I7, respectively. The collector of Q19 and the emitters of Q20 and Q22 are connected to V+, while the collector of Q21 and I8 are connected to V−. With I8 equal to $I_X$, and ignoring second order effects, the base current flowing into Q19 will be $I_X/B$, the collector currents of Q20 and the emitter current of Q21 will also be $I_X/B$, the base current drawn from Q22 will be $I_X/B^2$, and the collector currents of Q22 (which provide I6 and I7) will each be $I_X/B$.

The result of the above circuitry is an analog multiplier which has little or no nonlinearity with respect to the Y input signal, and a nonlinearity with respect to the X input signal which is trimmable to a zero or near-zero level. Since numerous modifications and alternate embodiments will occur to those skilled in the art, it is intended that the invention be limited only in terms of the appended claims.

I claim:

1. In an analog multiplier circuit for multiplying two signals X and Y, the circuit including current sources having magnitudes $xI_B$, $(1-x)I_B$, $yI_E$ and $(1-y)I_E$, where x and y are dimensionless indices of X and Y, respectively, in the range zero to unity and $I_B$ and $I_E$ are fixed currents, first and second differential amplifiers each comprising a pair of bipolar transistors with a common collector-emitter circuit connection; the $yI_E$ and $(1-y)I_E$ current sources connected to supply current to the first and second amplifiers, respectively, said amplifiers providing an output for the multiplier circuit, and a base drive circuit connected in circuit with the $xI_B$ and $(1-x)I_B$ current sources to provide base drive current to said amplifier transistors, the improvement comprising a base drive circuit which comprises:

first and second bipolar transistors having their collector-emitter circuits connected in circuit with the $xI_B$ and $(1-x)I_B$ sources, respectively, third the fourth bipolar transistors having their collector-emitter circuits connected in circuit with the $xI_B$ and $(1-x)I_B$ current sources, respectively, means connecting the collector-emitter circuits of the first and second transistors to provide base drive currents to respective transistors in the first amplifier, means connecting the collector-emitter circuits of the third and fourth transistors to provide base drive currents to respective transistors in the second amplifier, first bias means connected to apply bias voltages to the bases of the first and second transistors, first voltage trimming means connected to apply a trimming voltage differential between the bases of the first and second transistors and thereby adjust the voltage offset between those transistors, second bias means connected to apply bias voltages to the bases of the third and fourth transistors, and second voltage trimming means connected to apply a trimming voltage differential between the bases of the third and fourth transistors independently of the first voltage trimming means, and thereby independently adjust the voltage offset between those transistors, whereby nonlinearities between the multiplier circuit output and the X voltage signal may be reduced by appropriate trimming of said base voltage differentials.

2. The analog multiplier circuit of claim 1, wherein the collector-emitter circuits of the first and third transistors are connected in series, and the collector-emitter circuits of the second and fourth transistors are connected in series.

3. The analog multiplier circuit of claim 1, the first and second transistors being connected so that their collector-emitter currents supply both the collector-emitter currents of the third and fourth transistors and the base currents of the first amplifier transistors, respectively, and further comprising current source means connected to supply the standing base currents of the first amplifier transistors.

4. The analog multiplier circuit of claim 1, wherein said first and second transistors are connected as diodes.

5. The analog multiplier circuit of claim 1, wherein said first and second voltage trimming means are adapted to apply trimming voltages which are substantially directly proportional to absolute temperature over a predetermined temperature range.

6. The analog multiplier circuit of claim 1, 2, 3, 4 or 5, further comprising circuitry to make collector-emitter current imbalances between the first and second transistors on the one hand and the third and fourth transistors on the other hand independent of the Y voltage signal and thereby reduce nonlinearities between the multiplier circuit output and the Y voltage signal, said circuitry comprising:

fifth and sixth bipolar transistors matched with and having a common base connection with respective ones of the transistors in the first differential amplifier, the collector-emitter circuits of said fifth and sixth transistors connected to be supplied with current by the $(1-y)I_E$ current source, and seventh and eighth bipolar transistors matched with and having a common base connection with respective ones of the transistors in the second differential amplifier, the collector-emitter circuits of said seventh and eighth transistors connected to be supplied by the $yI_E$ current source, whereby the base drive currents provided by the first through fourth transistors are substantially proportional to $yI_E+(1-y)I_E$, and thereby substantially independent of the Y voltage signal.

7. In an analog multiplier circuit for multiplying two signals X and Y, the circuit including current sources having magnitudes $xI_B$, $(1-x)I_B$, $yI_E$ and $(1-y)I_E$, where x and y are dimensionless indices of X and Y, respectively, in the range zero to unity and $I_B$ and $I_E$ are fixed currents, first and second differential amplifiers each comprising a pair of bipolar transistors with a common collector-emitter circuit connection, the $yI_E$ and $(1-y)I_E$ current sources connected to supply current to the first and second amplifiers, respectively, said amplifiers providing an output for the multiplier circuit, and a base drive circuit connected in circuit with the $xI_B$ and $(1-x)I_B$ current sources to provide base drive currents to said amplifier transistors, the improvement comprising circuitry to make imbalances between said base drive currents substantially independent of the Y voltage signal, and thereby reduce nonlinearities between the multiplier circuit output and the Y voltage signal, said circuitry comprising:

a plurality of compensation bipolar transistors matched with and having common base connections with respective ones of the amplifier transistors, the compensation transistors which have a common base connection with the amplifier transistors supplied by the $yI_E$ current source having their collector-emitter circuits connected to be supplied with current from the $(1-y)I_E$ current source, and the compensation transistors which have a common base connection with the amplifier transistors supplied by the $(1-y)I_E$ current source having their collector-emitter circuits connected to be supplied with current from the $yI_E$ current source, whereby the base drive currents provided by said base drive circuit are substantially proportional to $yI_E+(1-y)I_E$, and thereby substantially independent of the Y voltage signal.

8. In an analog multiplier circuit for multiplying two signals X and Y, the circuit including first and second current sources having current magnitudes which vary in mutual opposition with respect to the X signal, third and fourth current sources having current magnitudes which vary in mutual opposition with respect to the Y signal, first and second differential amplifiers each comprising a pair of npn transistors having a common emitter connection, the third and fourth current sources connected to supply current to the first and second amplifiers, respectively, the collectors of the amplifier transistors providing an output for the multiplier circuit, and a base drive circuit connected in circuit with the first and second current sources to provide base drive currents to said amplifier transistors, the improvement comprising a base drive circuit which comprises:

first and second npn transistors having their emitters connected in circuit with the first and second current sources, respectively, third and fourth npn transistors having their emitters connected in circuit with the first and second current sources, respectively, means connecting the emitters of the first and second transistors to provide base drive currents to respective transistors in the first amplifier, means connecting the emitters of the third and fourth transistors to provide base drive currents to respective transistors in the second amplifier, first bias means connected to apply bias voltages to the bases of the first and second transistors, first voltage trimming means connected to apply a trimming voltage differential between the bases of the first and second transistors and thereby adjust the voltage offsets between those transistors, second bias means connected to apply bias voltages to the bases of the third and fourth transistors, and second voltage trimming means connected to apply a trimming voltage differential between the bases of the third and fourth transistors independently of the first voltage trimming means, and thereby independently adjust the voltage offset between those transistors, whereby nonlinearities between the multiplier circuit output and the X voltage signal may be reduced by appropriate trimming of said base voltage differentials.

9. The analog multiplier of claim 8, wherein the emitters of the first and second transistors are connected to the collectors of the third and fourth transistors, respectively.

10. The analog multiplier of claim 8, the first and second transistors being connected so that their emitter currents supply both the collector currents of the third and fourth transistors and the base currents of the first amplifier transistors, respectively, and further comprising current source means connected to supply the standing base currents of the first amplifier transistors.

11. The analog multiplier circuit of claim 8, wherein said first and second transistors are diode-connected with their bases and collectors connected in common.

12. The analog multiplier circuit of claim 8, wherein said first and second voltage trimming means are adapted to apply trimming voltages which are substantially directly proportional to absolute temperature over a predetermined temperature range.

13. The analog multiplier circuit of claim 8, 9, 10, 11 or 12, further comprising fifth and sixth npn transistors matched with and having a common base connection with respective ones of the transistors in the first amplifier, the emitters of the fifth and sixth transistors connected to be supplied with current from the fourth current source, and seventh and eighth npn transistors matched with and having a common base connection with respective ones of the transistors in the second amplifier, the emitters of the seventh and eighth transistors connected to be supplied with current from the third current source, whereby the first through fourth transistors each provide base drive currents to respective pairs of matched transistors, one transistor of each pair being supplied with current from the third current source and the other transistor of each pair being supplied with a current of opposing magnitude from the fourth current source, said base drive currents thereby being substantially independent of the Y signal.

14. The analog multiplier circuit of claim 13, the fifth and sixth transistors having their emitters connected to the collectors of respective transistors in the second amplifier and their collectors connected to the multiplier circuit output, and the seventh and eighth transistors having their emitters connected to the third current source and their collectors connected to the common emitter connection of the first amplifier transistors.

15. In an analog multiplier circuit for multiplying two signals X and Y, the circuit including first and second current sources having current magnitudes which vary in mutual opposition with respect to the X signal, third and fourth current sources having current magnitudes which vary in mutual opposition with respect to the Y signal, first and second differential amplifiers each comprising a pair of npn transistors having a common emitter connection, the third and fourth current sources connected to supply current to the first and second amplifiers, respectively, the collectors of the amplifier transistors providing an output for the multiplier circuit, and a base drive circuit connected in circuit with the first and second current source to provide base drive currents to said amplifier transistors, the improvement comprising circuitry to make imbalances between said base drive currents substantially independent of the Y signal and thereby reduce nonlinearities between the multiplier circuit output and the Y signal, said circuitry comprising:

a plurality of compensation npn transistors matched with and having common base connections with respective ones of each of the amplifier transistors, the compensation transistors which have a common base connection with the first amplifier transistors having their emitters connected to be supplied with current from the fourth current source, and the compensation transistors which have a common base connection with the second amplifier transistors having their emitters connected to be supplied with current from the third current source.

16. The analog multiplier circuit of claim 15, the compensation transistors which have common base connections with the first amplifier transistors having their emitters connected to the collectors of respective transistors in the second amplifier and their collectors connected to the multiplier circuit output, and the compensation transistors which have common base connections with the second amplifier transistors having their emitters connected to the third current source and their collectors connected to the common emitter connection of the first amplifier transistors.

* * * * *